United States Patent [19]

Loch

[11] 4,445,452

[45] May 1, 1984

[54] HYDROFOIL ASSEMBLY

[76] Inventor: Joseph Loch, 823 Forest St., Ottawa, Ontario, Canada, K2B 5P8

[21] Appl. No.: 323,134

[22] Filed: Nov. 19, 1981

[30] Foreign Application Priority Data

Dec. 19, 1980 [CA] Canada ..... 367168

[51] Int. Cl.[3] ..... B63B 1/30

[52] U.S. Cl. ..... 114/282; 114/271; 440/66

[58] Field of Search ..... 440/51, 66, 71, 76, 440/77; 114/145 A, 271, 274, 275, 280, 282

[56] References Cited

U.S. PATENT DOCUMENTS

| | | | |
|---|---|---|---|
| 2,713,317 | 7/1955 | Herz . | |
| 2,998,791 | 9/1961 | Light . | |
| 3,164,116 | 1/1965 | Lopez . | |
| 3,185,120 | 5/1965 | Bader . | |
| 3,211,119 | 10/1965 | Kiekhaefer . | |
| 3,247,820 | 4/1966 | White . | |
| 3,342,155 | 9/1967 | Hook . | |
| 3,433,195 | 3/1969 | Poole . | |
| 3,581,696 | 6/1971 | Hon . | |
| 3,648,641 | 3/1972 | Normand, Jr. . | |
| 3,980,035 | 9/1976 | Johansson | 440/66 |
| 4,056,074 | 11/1977 | Sachs | 114/280 |

FOREIGN PATENT DOCUMENTS

| | | | |
|---|---|---|---|
| 586246 | 10/1959 | Canada . | |
| 768429 | 10/1967 | Canada . | |
| 840150 | 4/1970 | Canada . | |
| 735735 | 11/1932 | France | 114/280 |

*Primary Examiner*—Trygve M. Blix
*Assistant Examiner*—Stephen P. Avila
*Attorney, Agent, or Firm*—Larson and Taylor

[57] ABSTRACT

An hydrofoil assembly for small craft is disclosed. The assembly includes two hydrofoils independently mounted on a boat or a propulsion unit of the boat's motor for free pivotal movement between a depending position and a extended in-use position. The foils automatically adopt the in-use position during forward movement and drop to their depending positions whenever their angle of attack becomes negative, such as in reverse movement when pivoted up to clear an obstacle, or when the boat is stationary.

11 Claims, 5 Drawing Figures

HYDROFOIL ASSEMBLY

FIELD OF THE INVENTION

The present invention relates to hydrofoil assemblies, and more particularly to hydrofoil assemblies suitable for use on such boats as small pleasure craft.

BACKGROUND OF THE INVENTION

The use of hydrofoils on relatively large craft has been known for some years. The purpose of such foils is to allow a vessel in which they are attached to ride with its hull above the water surface, thus reducing drag and therefore power requirements.

There have been recent attempts to apply this technology to small craft such as pleasure boats. Fixed hull-mounted foils are unsuitable for most small craft because they require a considerably increased draft for docking and low speed operation. This has led to the use of rather complex and expensive arrangements for retracting and extending such foils.

There have also been attempts to employ hydrofoils giving limited lift to improve the planing characteristics of small boats. Reference may be made, for example, to U.S. Pat. No. 3,433,195 which discloses a fixed foil attachment mounted on the propulsion unit of an outboard motor. The difficulty with an arrangement of this sort is that, while it may operate well during normal forward motion of the boat, it can have detrimental effects on the behaviour of the craft at other times. Thus, if the boat is driven in reverse by reversing the drive of the motor, the angle of attack of the foils will be negative, and this will tend to draw the stern of the boat down into the water. During forward motion, if the propulsion unit impacts on an underwater obstacle and pivots upwardly to the rear, the foils again adopt a negative angle of attack, drawing the stern of the boat downwardly and generating a strong decelerating force which chould be sufficiently strong as to have a destructive effect on the transom of the boat or the propulsion unit itself.

SUMMARY OF THE INVENTION

The present invention aims at the provision of an hydrofoil assembly that can suitably be used for small boats.

According to the present invention there is provided an hydrofoil assembly comprising a pair of hydrofoils and means for mounting said hydrofoils on a boat for free independent pivotal movement about respective fore and aft oriented pivot axes below the working water line of the boat, each hydrofoil being pivotable between a depending position projecting downwardly from the respective pivot axis and having a positive angle of attack with respect to surrounding water, and an extended in use position projecting substantially laterally from the associated pivot axis and having a positive angle of attack with respect to the surrounding water, and means preventing each said foil from pivoting upwardly beyond said extended in use position.

With the free pivotal mounting of the foils, they hang down from their pivot axes when the boat is stationary. During forward motion, the positive angle of attack produces a lift on the foils, drawing them up to their extended position, where they create a lift on the boat. When the boat is in rearward motion, the foils have a negative angle of attack in their extended position, and this will cause them to collapse down to their depending position, so that no negative lift is produced on the boat.

The foils may be mounted on the outboard propulsion unit of the boat's motor, similar to the arrangement provided for in U.S. Pat. No. 3,433,195, although with the foils pivotably mounted. This is particularly useful where it is anticipated that the craft will travel in shallow waters or in waters where underwater obstacles may be encountered. When the propulsion unit pivots upwardly as a result of contact with the bottom or an obstacle, the foils will adopt a negative angle of attack. Because of their pivotal mounting, the foils will pivot downwardly to their depending positions where no negative lift is produced. Similar arrangements could be provided with the foils pivotally mounted on the hull of the boat to swing upwardly to the rear upon impact with the bottom or an underwater object. This would require some additional mechanism for retaining the foils in their operative positions until such impact. This could be, for example, a latch or a shear pin arrangement.

In another embodiment, the foils are mounted on an arm pivotted to the horizontal pivot pin of the motor mount so as to be positioned directly in front of the propulsion unit. Engagement with the mount or the propulsion unit below the pivot pin holds the arm and foils in place during normal operation, while permitting upward pivoting motion with the motor to clear obstacles.

In any event, the foils are to be freely pivotable to prevent creating a negative lift and considerable deceleration on the hull of the boat.

BRIEF DESCRIPTION OF THE DRAWINGS

In drawings which illustrate an exemplary embodiment of the present invention.

DETAILED DESCRIPTION OF ILLUSTRATED EMBODIMENT

Figures 1, 2, 3:
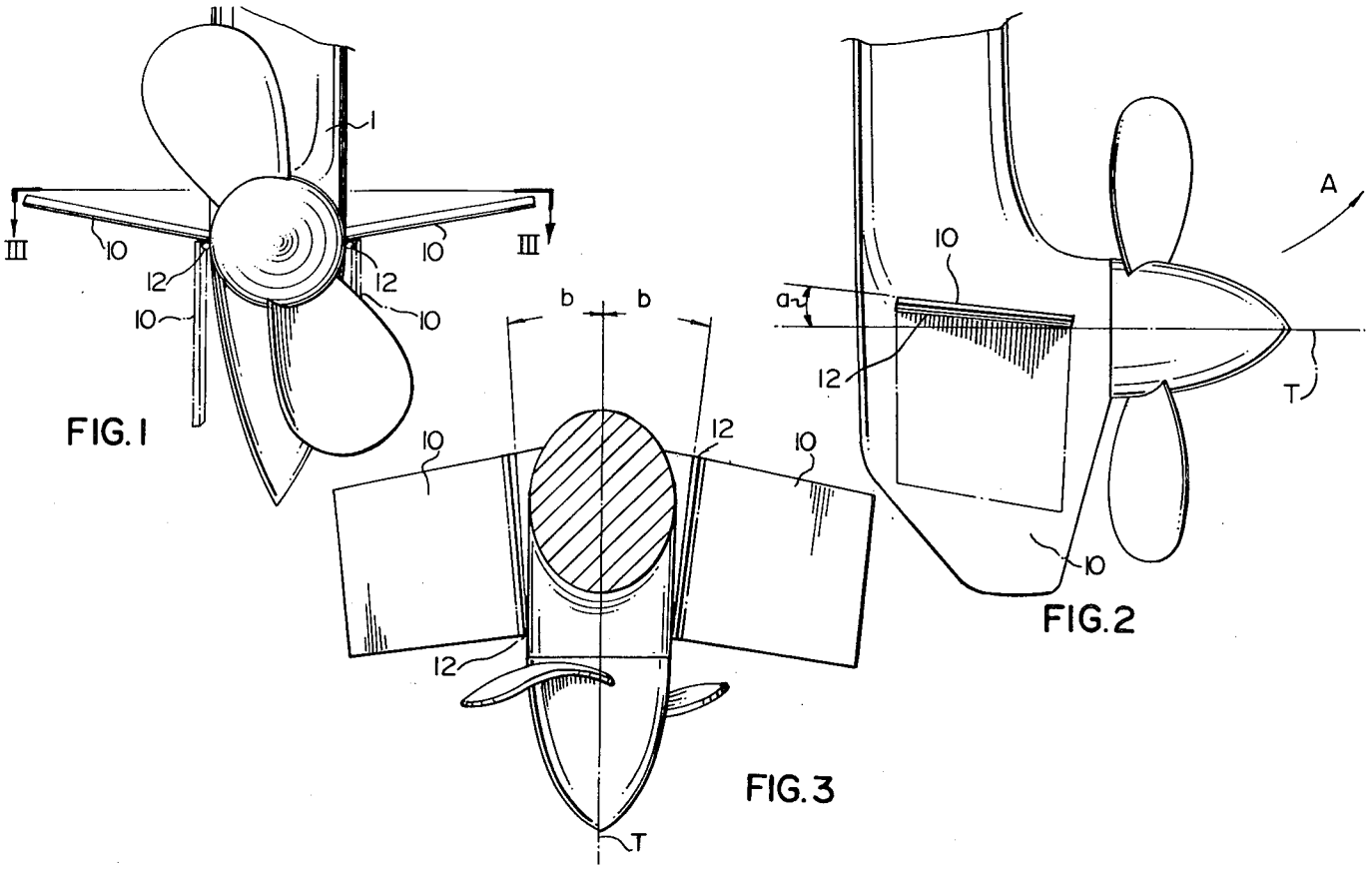
FIG. 1 is a rear elevation of an hydrofoil assembly mounted on a propulsion unit of an outboard or inboard-outboard motor.
FIG. 2 is a side elevation of the unit of FIG. 1.
FIG. 3 is a section along line III—III of FIG. 1.

Referring to the drawings, there is illustrated an outboard propulsion unit of the type commonly employed in outboard or inboard-outboard motors. With motors of this sort, the propulsion unit, either in combination with the motor in the case of an outboard motor, or alone in the case of an inboard-outboard motor, is arranged to pivot upwardly to the rear, in the direction of the arrow A in FIG. 2, upon impact with the bottom or an underwater object.

Two hydrofoils 10 are mounted on the housing of the propulsion unit 1 by respective hinges 12. Each foil pivots freely between the position shown in solid lines, where it extends laterally from the housing and slopes slightly upwardly, and a collapsed position shown in broken line, where it hangs vertically from the hinge connection to the housing. A stop mechanism (not shown) is provided to limit the upwards pivoting movement of each foil to the solid line position illustrated.

As shown in FIG. 2, the pivot axis of each hinge 12 slopes upwardly at an angle a from the line of thrust T of the propulsion unit so as to produce a positive angle of attack for each of the foils 1O in the extended position, thus ensuring the production of a positive lift on the foil as it moves forwardly through the water.

When the drive is put in reverse and the boat moves to the rear each of the foils 10 will have a negative angle of attack. This will produce a negative lift on the foils, tending to draw the stern of the boat down in the water if the foils were retained in their extended positions. However, because of the free pivotal movement of the foils about the hinges 12, they will be swung down by this negative lift into the collapsed position illustrated in broken lines, eliminating the negative lift on the boat.

As illustrated in FIG. 3, the axes of the hinges diverge forwardly, each making an angle b with the line of thrust T. As a consequence, when a foil 10 is in its depending position and the boat begins to move forwardly there is a positive angle of attack between the foil and the water through which it is moving, which will produce a lift on the foil, pivoting it upwards about its hinge 12 until it reaches its fully extended position. Conversely, upon rearward motion of the boat, the foils will be returned to their collapsed positions as described in the foregoing and will be retained there by the negative angle of attack in those positions.

When the propulsion unit encounters an object during forward motion of the boat and pivots upwardly in the direction illustrated by the arrow A in FIG. 2, the angle of attack of the foils 10 quickly becomes neutral and then negative. The negative angle of attack would tend to draw the stern of the boat down into the water and create a strong drag on the motor decelerating the boat and possibly damaging it. This does not occur because the foils automatically return to their collapsed position through pivoting about the hinges 12.

As will be observed from FIG. 1, the foils slope upwardly to the outside when in their extended positions. The angle of this slope is between 1O° and 25° to the horizontal. The slight positive V of the extended wings provides an automatic longitudinal stability for the boat. It also assists the foils to stay in their extended position despite pressure on them through relative lateral motion of the propulsion unit and the surrounding water as might occur, for example, during turns.

Figure 4:
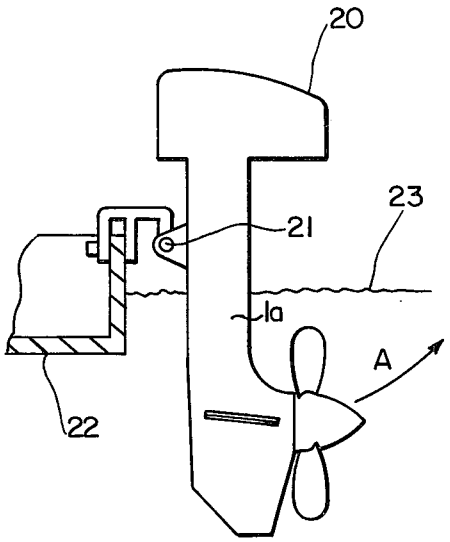
FIG. 4 is a somewhat schematic view showing the hydrofoil assembly mounted on an outboard motor.
Figure 5:
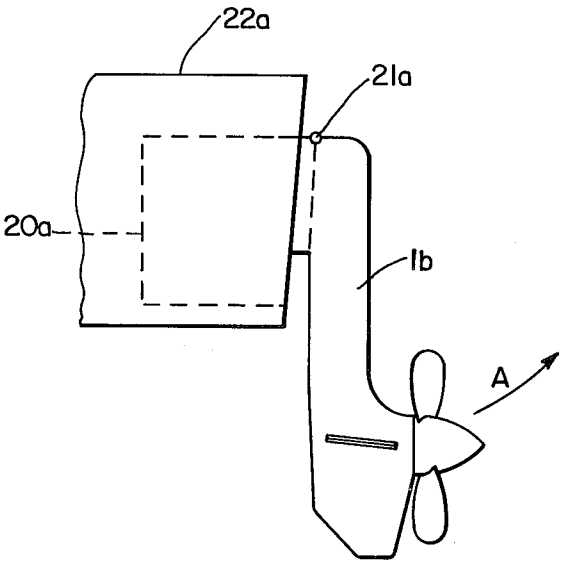
FIG. 5 is a similar view showing an inboard-outboard motor.

FIG. 4 shows an outboard motor 20 connected by a pivot 21 in a conventional manner to the rear of a boat 22. The hydrofoils 10 are attached to the sides of the housing l*a* to be positioned as shown below the working water line 23. FIG. 5 shows an inboard-outboard motor arrangement. The motor 20*a* is in the boat 22*a* and the propulsion unit housing 1*b* has a pivot connection 21*a* to the motor so that it can be pivoted upwardly and rearwardly in the direction of the arrow A.

While one particular embodiment of the present invention has been described, it is to be understood that other embodiments are within the scope of the present invention. Thus, the particular placement of the foils on the propulsion unit can be varied within wide limits, according to the particular installation. The foils may also be mounted on the hull of the boat rather than on the propulsion unit, or on some other part of the motor, such as the mount for an outboard motor. Where this is done, it may be desirable to provide a mechanism permitting the foils to pivot upwardly and to the rear upon impact with an underwater object. While the foils of the illustrated embodiment are parallel to their pivot axes, and the axes are oriented so as to provide the desired angle of attack, the same effect can be provided in other ways. For example, the pivot axes may be parallel and horizontal, with each foil mounted on its respective hinge at a skewed orientation with respect to the pivot axis of the hinge. Other embodiments will no doubt readily occur to those skilled in the art. Thus, the present invention is to be considered limited only by the scope of the appended claims.

What I claim as my invention is:

1. An hydrofoil assembly comprising: a pair of hydrofoils, and mounting structure for attaching said hydrofoils to a boat such that in an operative condition said hydrofoils are disposed below the working water line of the boat, said mounting structure defining a pivotal mounting for each hydrofoil about a respective pivot axis which in the operative condition is disposed in a generally fore-and-aft orientation, each hydrofoil being pivotable between a retracted position projecting downwardly from the respective pivot axis and an extended position projecting substantially laterally from the associated pivot axis and means preventing each said foil from pivoting upwardly beyond said extended position, each said hydrofoil in the operative condition having a positive angle of attack with respect to the surrounding water such that in forward motion of the boat the water reacts with the hydrofoil to urge it towards said extended position, said mounting structure being adapted to be connected to the boat to be pivotable about a transverse axis and displaceable rearwardly and upwardly from said operative condition upon encounter with an underwater obstacle, such displacement altering the attitude of said hydrofoils so that said angle of attack becomes negative and the reaction of the water urges the hydrofoils to the retracted position.

2. An hydrofoil assembly according to claim 1 wherein the mounting structure comprise a pair of hinges connected to respective ones of said hydrofoils.

3. An hydrofoil assembly according to claim 2 wherein each said hydrofoil is mounted on the respective hinge to extend in a plane substantially parallel to the pivot axis thereof, the pivot axes of the hinges in the operative condition sloping upwardly and diverging towards the bow of the boat.

4. An hydrofoil assembly according to claim 1, 2 or 3 wherein said assembly is adapted to be mounted on an outboard propulsion unit of the boat.

5. An hydrofoil assembly according to claim 1 wherein said mounting structure comprises an outboard propulsion unit of the boat.

6. An hydrofoil assembly according to claim 5, 2 or 3 wherein each said foil in the operative condition and in the extended position slopes upwardly from the horizontal at an angle between 10° and 15°.

7. A boat motor having a propulsion unit adapted to be pivotally mounted on a transverse axis with respect to a boat and in an operative condition to extend downwardly below the working water line of the boat;

said pivotal mounting being such as to permit upwards and rearwards pivotal displacement of said propulsion unit upon impact with an underwater obstruction;

said motor including an hydrofoil assembly comprising: a pair of hinges mounted on said propulsion unit with their axes extending generally fore-and-aft in said operative condition;

a pair of hydrofoils each mounted on a respective one of said hinges for pivotal movement between a retracted position wherein it projects downwardly from the respective hinge and an extended position wherein it projects substantially laterally from the respective hinge and below sa d working water line, each said hydrofoil in the operative condition having a positive angle of attack with respect to the surrounding water such that upon forward movement of the boat the reaction of the water urges the hydrofoil upwardly towards its extended position; and stop means for limiting the upwards pivotal movement of each foil to said extended position;

wherein such pivotal displacement of said propulsion unit from said operative condition is effective to alter the attitude of said hinge axes such that the angle of attack of the hydrofoils becomes negative and the reaction of the water urges them to the retracted position.

8. A motor according to claim 7, wherein said motor is an outboard motor.

9. A motor according to claim 7 wherein said motor is an inboard-outboard motor.

10. A motor according to claim 7, 8 or 9 wherein in the operative condition the pivot axes of said hinges slope upwardly and diverge towards the front so as to provide the positive angle of attack of said hydrofoils.

11. A motor according to claim 7, 8 or 9 wherein in the operative condition in said laterally extending positions, said hydrofoils slope upwardly from the horizontal at an angle between 10° and 25°.

* * * * *